US006644743B1

(12) United States Patent
Lin

(10) Patent No.: US 6,644,743 B1
(45) Date of Patent: Nov. 11, 2003

(54) CHAIR CHASSIS

(76) Inventor: Chang-Chen Lin, No. 18, Lane 40, Te Yang Road, Yi Lan Hsien (TW)

( * ) Notice: Subject to any disclaimer, the term of this patent is extended or adjusted under 35 U.S.C. 154(b) by 0 days.

(21) Appl. No.: 10/379,451

(22) Filed: Mar. 4, 2003

(51) Int. Cl.[7] ..... A47C 1/032
(52) U.S. Cl. ..... 297/320; 297/317; 297/374
(58) Field of Search ..... 297/316, 317, 297/318, 320, 322, 340, 374

(56) References Cited

U.S. PATENT DOCUMENTS 2,400,588 A * 5/1946 McArthur ..... 297/317
4,045,081 A * 8/1977 Ueno ..... 297/317
4,068,888 A * 1/1978 Bottemiller ..... 297/317
5,211,444 A * 5/1993 Kjellman ..... 297/375
5,340,194 A * 8/1994 Neumuller ..... 297/301.3
5,423,595 A * 6/1995 Hancock ..... 297/374
6,467,842 B1 * 10/2002 Lu ..... 297/316
6,467,845 B1 * 10/2002 Chen ..... 297/374

* cited by examiner

*Primary Examiner*—Peter R. Brown
(74) *Attorney, Agent, or Firm*—Charles E. Baxley

(57) ABSTRACT

A chair includes a chair base, a seat mounted on top of the chair base, a backrest pivotally attached to a rear of the seat, and a chassis mounted below the seat. When the backrest is tilted rearward, the seat moves forward and urges a movable member of the chassis to shift. The chassis further has a positioning mechanism with at least one positioning plate for retaining the backrest in a desired inclination angle. The positioning plate carries a rear end of the seat upward when the backrest is tilted rearward, thereby further improving the sitting stability.

4 Claims, 8 Drawing Sheets

CHAIR CHASSIS

BACKGROUND OF THE INVENTION

1. Field of the Invention

The present invention relates to a chair chassis for improving supporting stability when the backrest of the chair is in a tilted state.

2. Description of the Related Art

FIG. 7 of the drawings illustrates a conventional chair comprising a base 1', a support frame 2', a seat 3', and a backrest 4'. The base 1' includes a post 11' in a central area thereof. The support frame 2' is formed by means of bending a metal tube and includes a bottom connected to the post 11'. The support frame 2' further includes a connecting block 21' on each of two sides thereof, with a positioning rod 22' attached to each connecting block 21'. The backrest 4' is connected to a rear of the support frame 2' at two sections of the support frame 2'. The seat 3' has a rear end connected to a bottom of the backrest 4'. Two sliding rods 31' are respectively provided to undersides of two sides of the seat 3' and extended through the connecting blocks 21'. When the backrest 4' is tilted rearward, the seat 3' shifts and the sliding rods 31' are moved accordingly. Further, the positioning rods 22' can be operated to be engaged with the sliding rods 31' for retaining the backrest 4' in the desired inclination angle.

However, when the backrest 4' is tilted rearward, the backrest 4' is not supported at its central area, failing to provide a stable support while the user lying his or her back in the backrest 4'. Further, the sliding rods 31' respectively slide along the connecting blocks 21' while the seat 3' is moving such that the sliding rods 31' are apt to shift from their normal position or the sliding rods 31' are apt to bend and deform, causing the sliding rods 31' to be stuck in the connecting blocks 21'. Further, the level of the seat 3' is not adjustable and thus not suitable for users of different heights. Further, the support frame 2' formed by means of bending cannot be folded after the chair is disassembled, causing inconvenience to transport and storage.

FIG. 8 of the drawings illustrates another conventional chair that includes a chassis 6' attached to an underside of a seat 5' and a backrest 7' attached to a rear of the seat 5'. An elastic means 61' is provided in the chassis 6' so that the front end of the seat 5' is moved upward when the backrest 7' is tilted rearward. However, the center of gravity of the user sitting in the chair is moved rearward while the backrest 7' is tilted rearward. As a result, the user might fall from the chair and thus be injured.

SUMMARY OF THE INVENTION

An object of the present invention is to provide a chair chassis for improving supporting stability by moving the seat forward when the backrest of the chair is in an inclined state.

Another object of the present invention is to provide a chair chassis that limits the maximum inclination angle of the backrest.

A further object of the preset invention is to provide a chair chassis allowing easy assembly and transport convenience.

A chair in accordance with the present invention includes:

a chair base;

a seat mounted on top of the chair base;

a backrest pivotally attached to a rear of the seat, the backrest including a support rod mounted thereon; and a chassis mounted below the seat, the chassis including a base, a positioning mechanism, a movable member, and a support frame;

the base including a rear end fixedly connected to the support frame, the base including an intermediate portion for connection with the positioning mechanism, the base further including a front end on which two guide plates are mounted for connecting with a front end of the movable member, each guide plate having a guide slot;

the positioning mechanism including at least one positioning plate and a control rod, said at least one positioning plate being mounted to the base and including an end connected to a rear end of the movable member, a top having a hole defined therein, and an intermediate portion having a slot defined therein, the control rod controlling said at least one positioning plate to move between a loosened position and a tightening position for retaining the backrest in a desired inclination angle;

the movable member including an upper end fixed to the seat, a front axle rod being mounted to a front end of the movable member and extending through the guide slots of the guide plates of the base, a rear axle rod being mounted to a rear end of the movable member and extending through the hole of said at least one positioning plate;

the support frame including a bottom fixed to a rear end of the base and a top pivotally connected to the support rod of the backrest;

wherein when the backrest is tilted rearward, the seat moves forward and urges the movable member to shift, with the front axle rod sliding along the guide slots of the guide plates, and with said at least one positioning plate moving together with the rear axle rod.

Other objects, advantages, and novel features of the invention will become more apparent from the following detailed description when taken in conjunction with the accompanying drawings.

BRIEF DESCRIPTION OF THE INVENTION

DETAILED DESCRIPTION OF THE PREFERRED EMBODIMENTS

Figure 1:
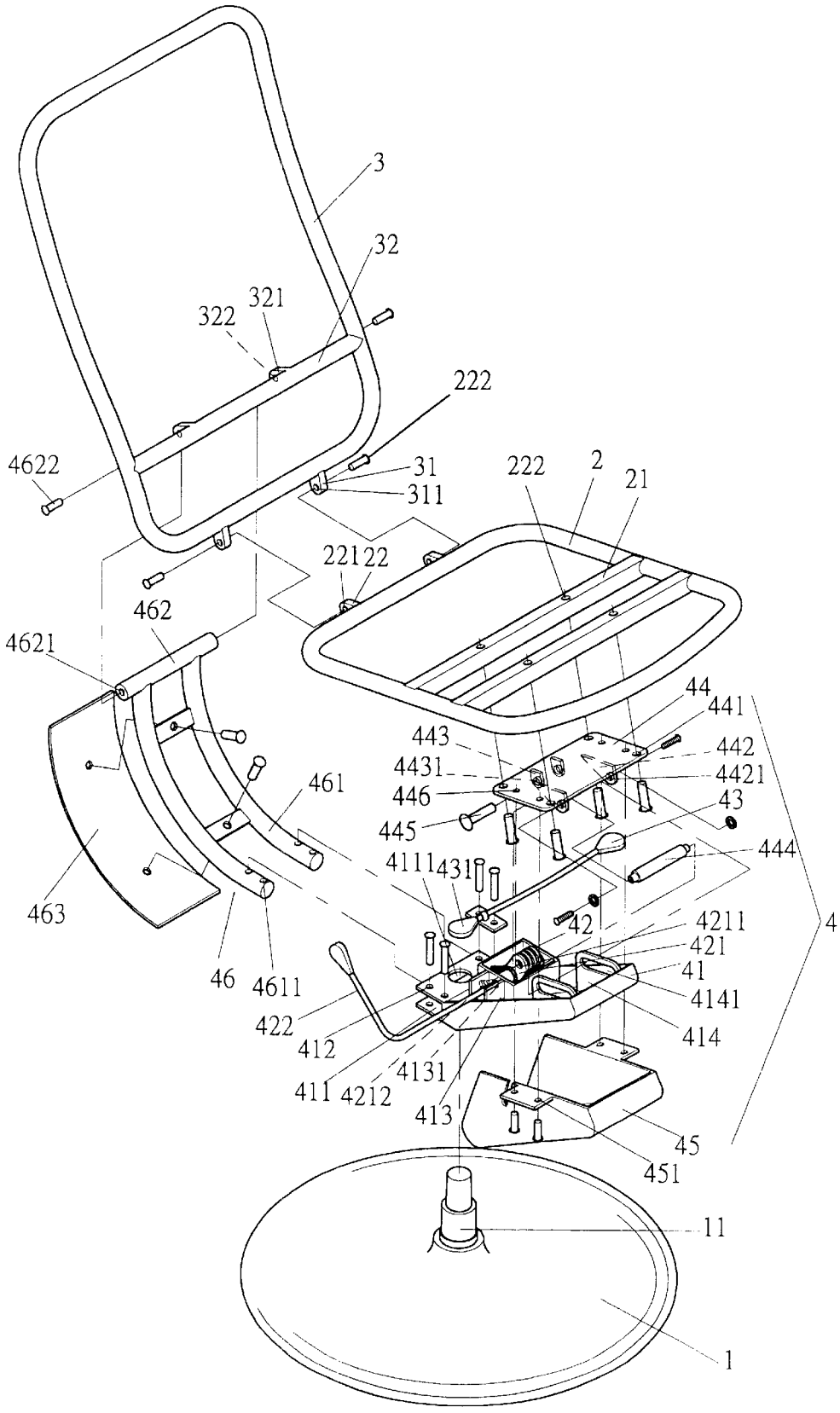
FIG. 1 is an exploded perspective view of a chair with a chassis in accordance with the present invention.
Figure 2:
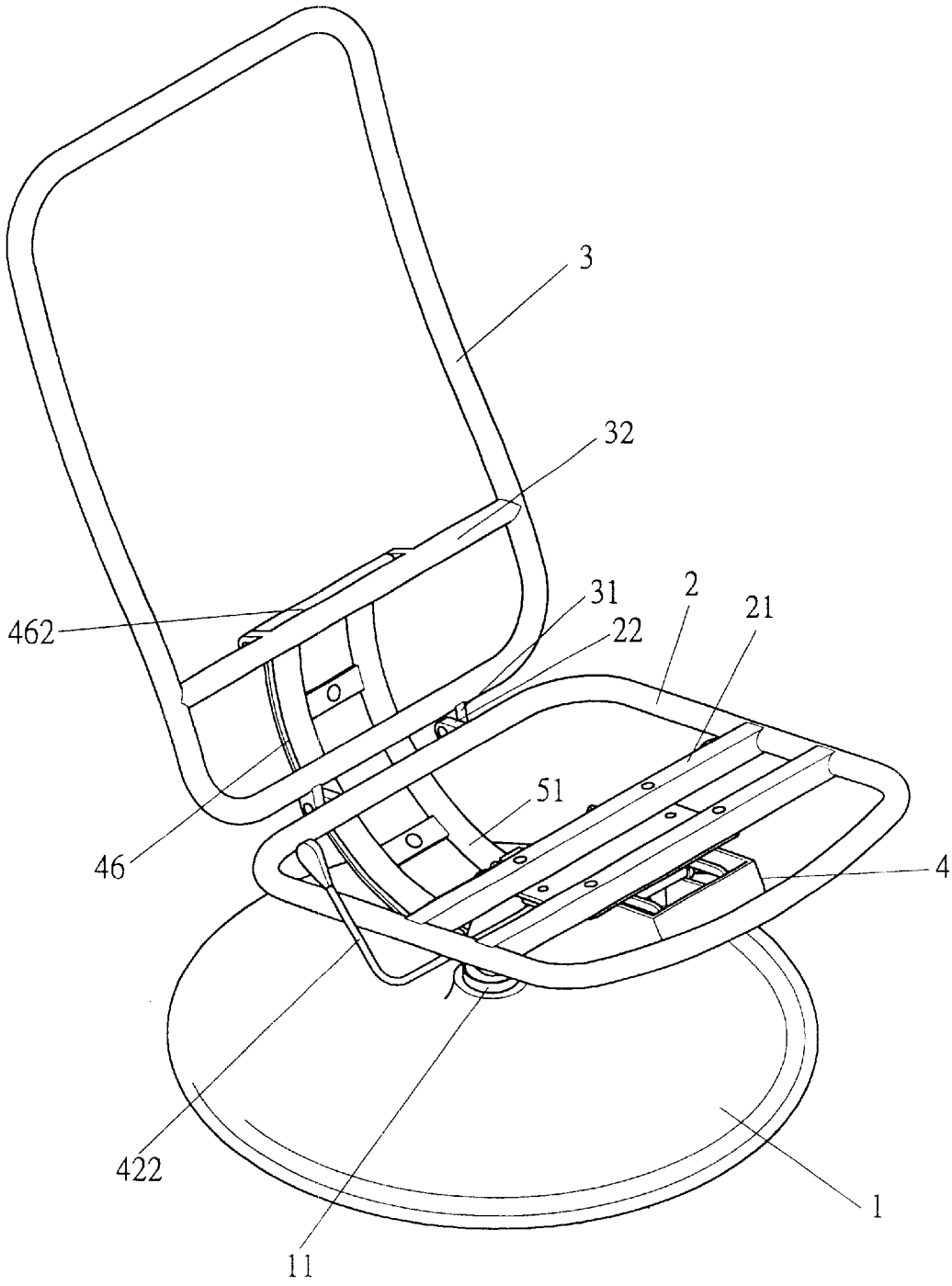
FIG. 2 is a perspective view of the chair in accordance with the present invention.
Figure 3:
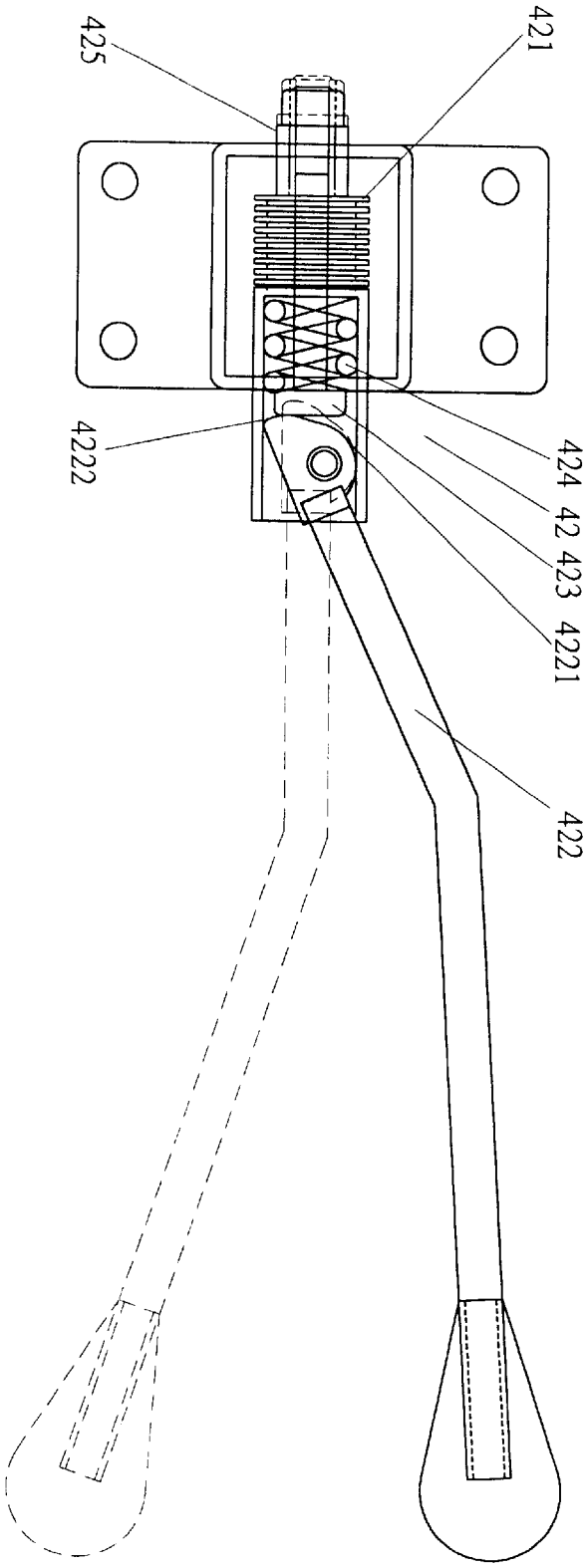
FIG. 3 is a sectional view of a positioning mechanism of the chair in accordance with the present invention.

Referring to FIGS. 1 through 3, a chair in accordance with the present invention generally comprises a chair base 1, a seat 2, a backrest 3, and a chassis 4. A pneumatic rod 11 is mounted to a center of the chair base 1. The seat 2 includes a connecting portion 21 in a central area thereof, the connecting portion 21 having holes 211 for connecting with the chassis 4. A pivotal portion 22 is formed on a rear of the seat 2 and includes holes 221 through which a pin 222 extends, thereby pivotally connecting the backrest 3 to the seat 2.

The backrest 3 includes a pivotal portion 31 at a bottom thereof, the pivotal portion 31 having holes 31 for cooperating with the pivotal portion 22 of the seat 2. The backrest 3 further has a support rod 32 extending in a horizontal direction and located in an intermediate portion of the backrest 3. The support rod 32 includes a pivotal portion 321 having holes 322 for pivotal connection with a support frame 46 of the chassis 46.

The chassis 4 includes a base 41, a positioning mechanism 42, an adjusting rod 43, a movable member 44, a cover 45, and the support frame 46 mentioned above. The base 41 includes a mounting portion 411 at a rear end thereof, the mounting portion 411 having holes 4111. The base 41 further has holes 412 for connection with the support frame 46. Further, a connecting portion 413 is formed on a central area of the base 41 and has a hole 4131 for connection with the positioning mechanism 42. Further, two guide plate 414 are mounted in front of the base 41 for connection with a front end of the movable member 44, each guide plate 414 having a guide slot 4141.

As illustrated in FIG. 3, the positioning mechanism 42 includes at least one positioning plate 421 and a control rod 422. The positioning plate 421 has a top with a hole 4211 for connection with a rear end of the movable member 44. An axle 423 is extended into a slot 4212 defined in an intermediate portion of the positioning plate 421 to thereby mount the positioning plate 421 to the base 41. An elastic element 424 is mounted around the axle 423, and a tightening member 425 is attached to an end of the axle 423. The positioning plate 421 is raised when the seat 2 is moved forward. The control rod 422 has an end pivotally engaged in the holes 4131 of the connecting portion 413 of the base 41. The control rod 422 further has an inclined side 4221 and a top 4222. The inclined side 4221 and the top 4222 of the control rod 422 control selective abutment of the pin 423. More specifically, the control rod 422 can be turned to make the top 422 abuts against the axle 423, causing the tightening member 425 not to press against the, positioning plate 421 such that the positioning plate 421 is in a loosened state. Alternatively, the control rod 422 can be turned to make the inclined side 4221 abut against the axle 423, causing the tightening member 425 to press against the positioning member 421 under the action of the elastic element 424, thereby retaining the positioning plate 421 in place.

Referring to FIGS. 1 and 2, the adjusting rod 43 is mounted to the mounting portion 411 of the base 41 and has an end 431 for actuating an end of the pneumatic rod 11. The movable member 44 includes holes 441 for connection with the seat 2. The movable member 44 further has a pivotal portion 442 with holes 4421 on a front end thereof. An axle 444 extends into the holes 4421 of the pivotal portion 442 and the guide slots 4141 of the base 41. The movable member 44 further has a pivotal portion 443 with holes 4431 on a rear end thereof. An axle 445 is extended through the holes 4431 of the pivotal portion 443 and the hole 4211 of the positioning plate 421. Further, the movable member 44 has holes 446 for connection with the cover 45. The cover 45 encloses the base 41 and includes holes 451 for connection with the movable member 44.

The support frame 46 includes a connecting portion 461 on a bottom thereof, the connecting portion 461 having holes 4611 for secure connection with the base 41. The support frame 46 further has a pivotal portion 462 on a top thereof, the pivotal portion 462 having a hole 4621 through which pins 4622 extends, thereby being pivotally connected to the support rod 32 of the backrest 3. The support frame 46 further has a cover plate 463 on an outer side thereof.

Figure 4:
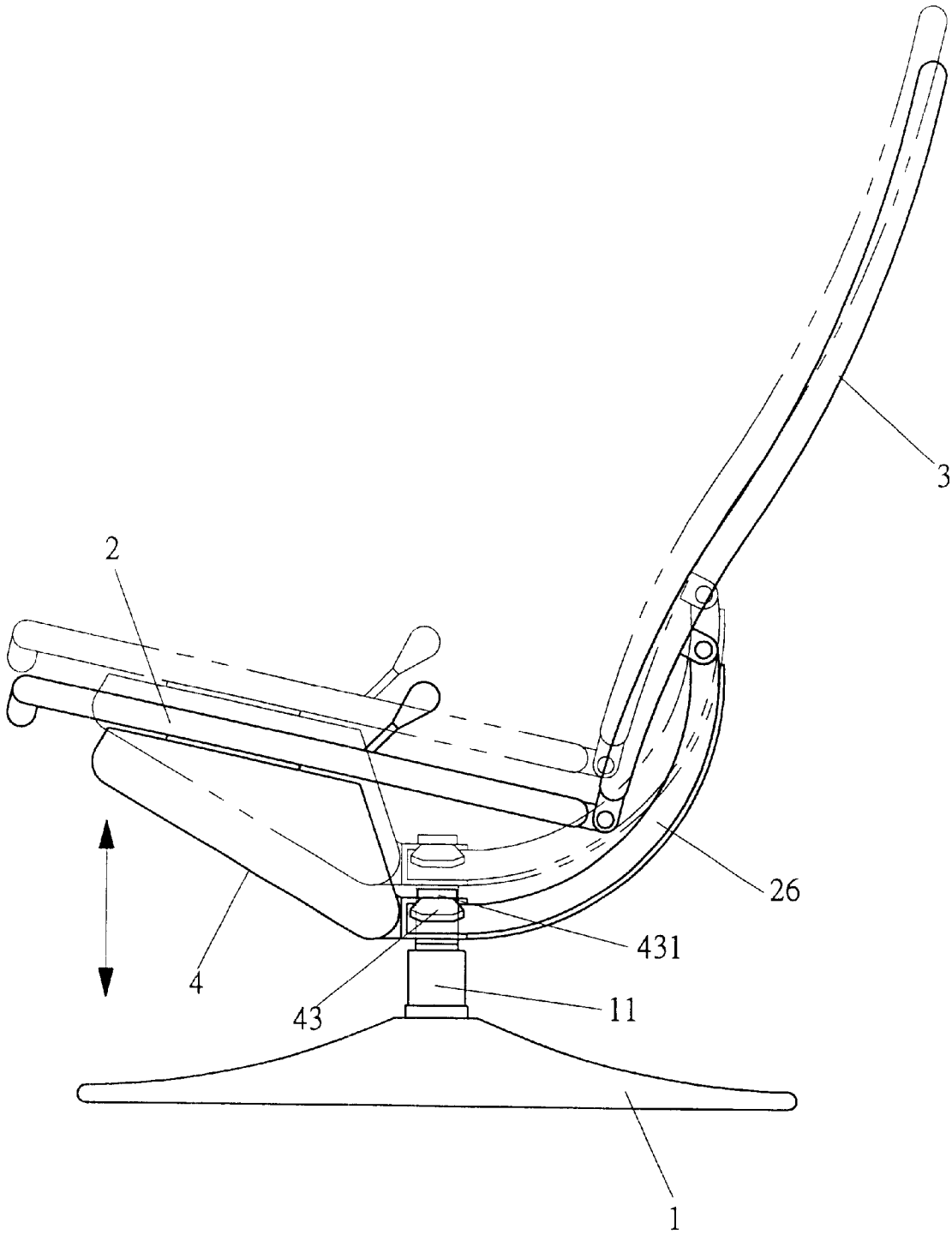
FIG. 4 is a side view of the chair, illustrating adjustment of the level of the seat.

The backrest 3 is pivotally connected by pins 22 at its bottom end to the seat 2, with the support frame 46 supporting the user lying in the chair. The support stability is improved. Further, the user may operate the adjusting rod 43 to actuate the pneumatic rod 11 to thereby adjusting the level of the seat 2, as shown in FIG. 4.

Figure 5:
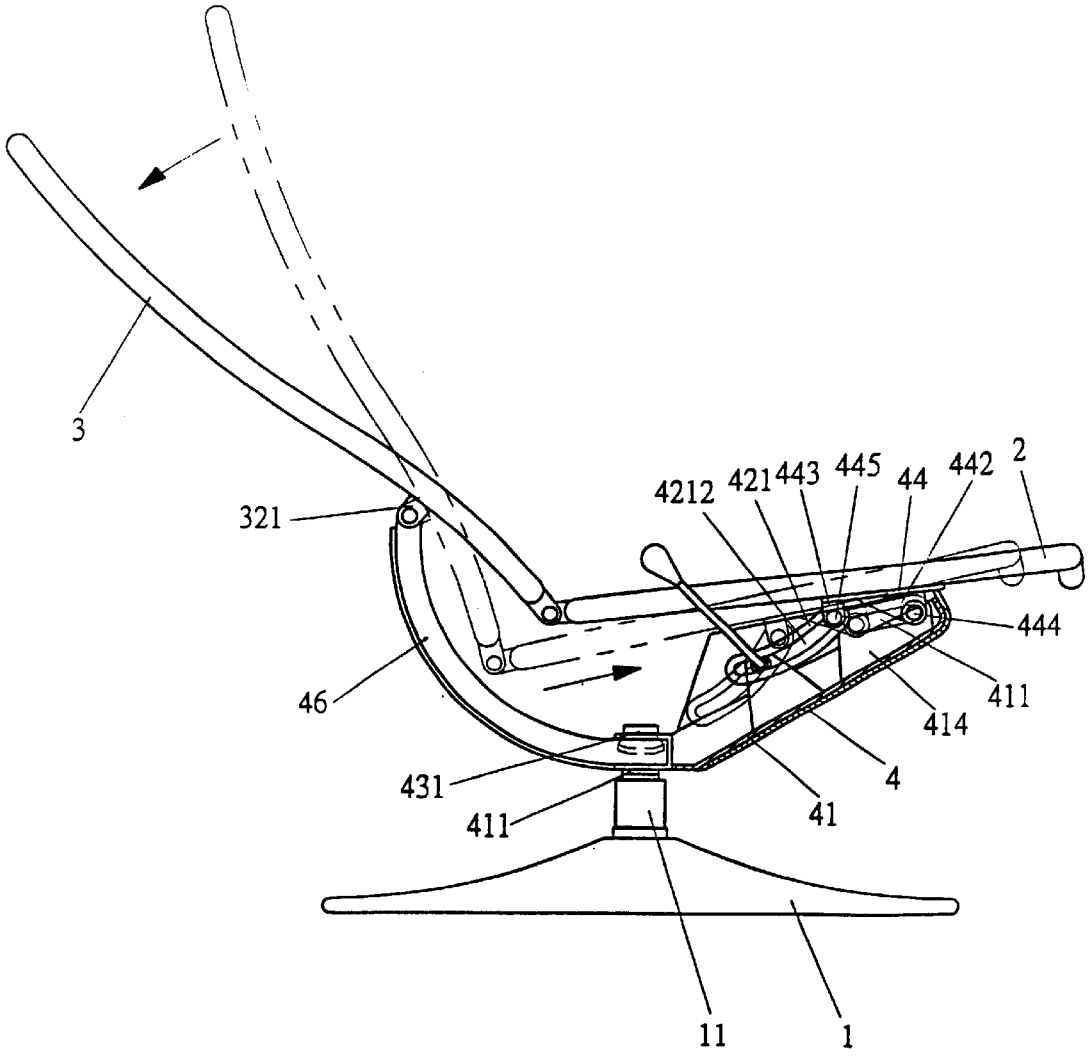
FIG. 5 is another side view of the chair, illustrating inclination of the backrest of the chair.

As illustrated in FIG. 5, when the backrest 3 is tilted rearward, the seat 2 together with the movable member 44 shifts, and the axle 444 is moved along the guide slots 4141. Thus, the seat 2 that provides a support for the buttock of the user is moved forward when the user lies rearward; namely, the buttock of the user is also moved forward together with the seat 2, and the center of gravity of the user is moved to thereby prevent falling of the user while the backrest 3 is tilted rearward. Further, the axle 445 carries the positioning plate 421 upward. Thus, the rear end of the seat 2 is raised to further improve the sitting stability. Further, during movement of the backrest 3, the end edge of each guide slot 4141 limits further movement of the axle 444, and the end edge of the slot 4212 of the positioning plate 421 stops further movement of the axle rod 445, thereby limiting the inclination angle of the backrest 3.

Figure 6:
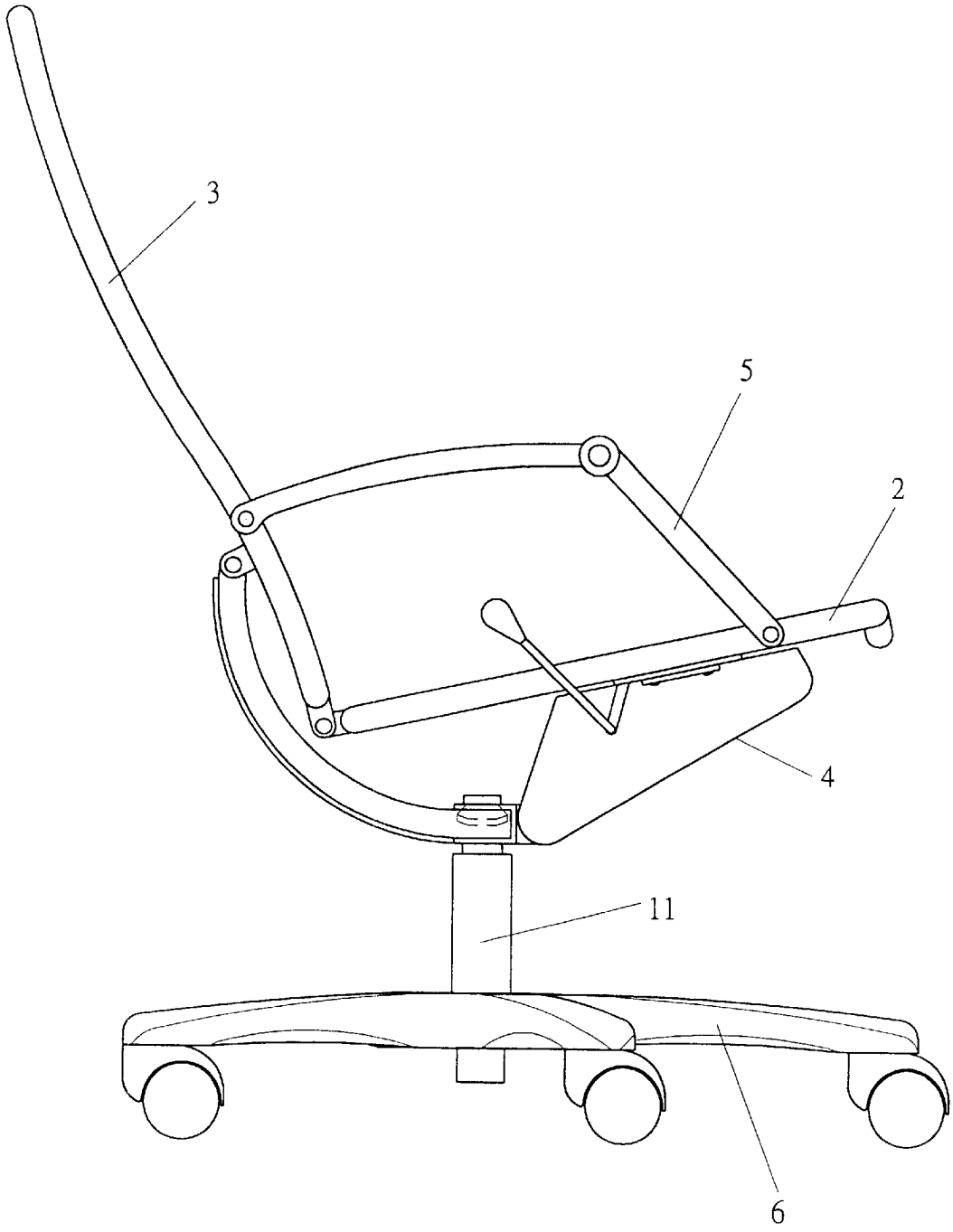
FIG. 6 is a side view of a modified embodiment of the chair in accordance with the present invention.
Figure 7:
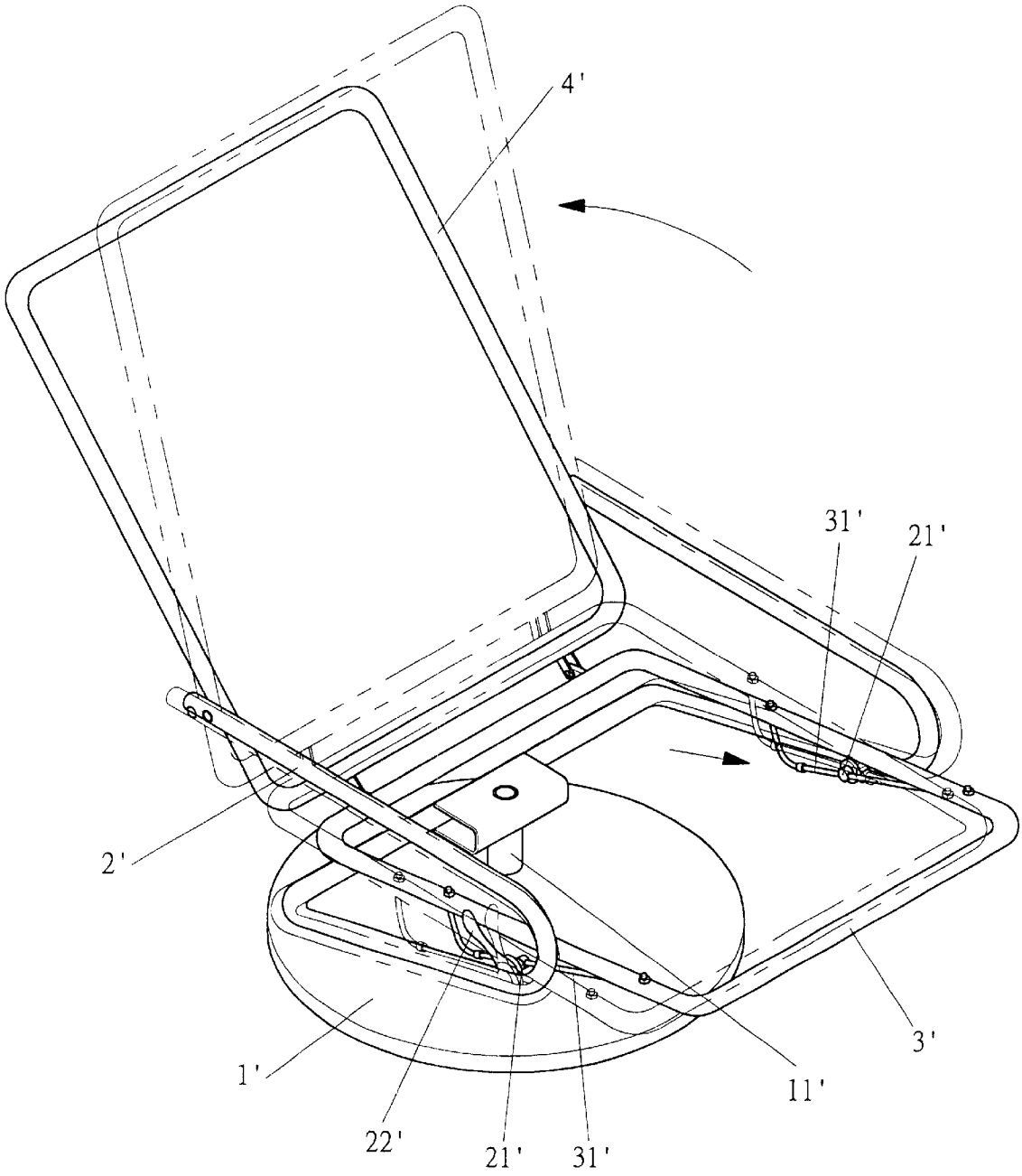
FIG. 7 is a perspective view of a conventional chair.
Figure 8:
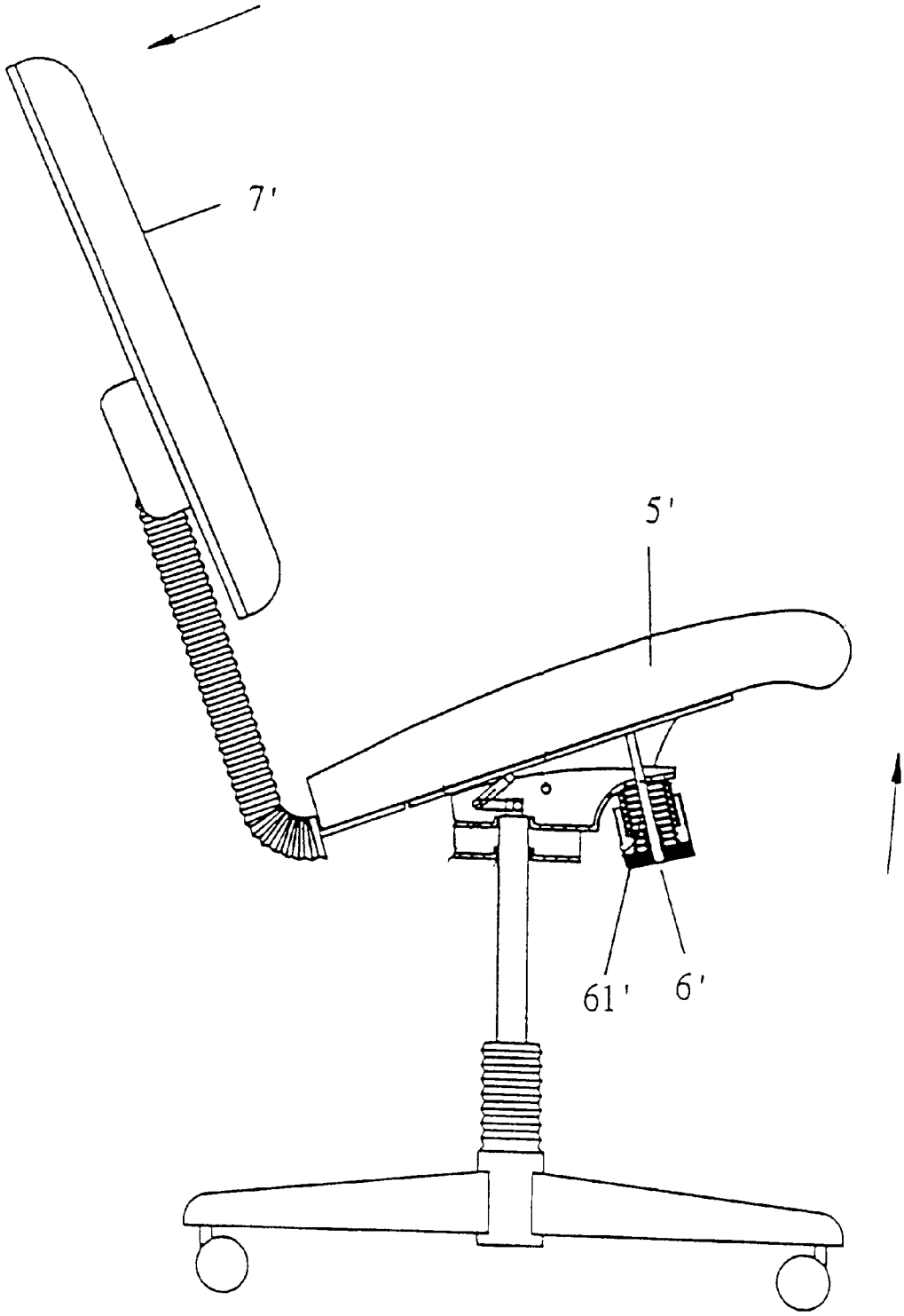
FIG. 8 is a perspective view of another conventional chair.

FIG. 6 illustrates a modified embodiment of the invention, wherein armrests 5 of desired types can be provided, and a leg assembly 6 with casters (not labeled) can be used to replace the base 1, which is still within the scope of the invention.

According to the above description, it is appreciated that the seat 2 can be moved forward while the backrest 3 is tilted rearward. The buttock of the user is thus moved forward to prevent the user from falling from the chair encountered in the prior art chair structure. Further, the support rod 32 of the backrest 3 provides improved support for the user. Further, the chair can be disassembled and thus occupies a smaller space when compared with the conventional designs, which is convenient to transport. The problem of being stuck of sliding rods of the conventional design as a result of shifting of the sliding rods is also avoided.

Although the invention has been explained in relation to its preferred embodiment, it is to be understood that many other possible modifications and variations can be made without departing from the scope of the invention as hereinafter claimed.

What is claimed is:

1. A chair comprising:

a chair base (1);

a seat (2) mounted on top of the chair base (1);

a backrest (3) pivotally attached to a rear of the seat (2), the backrest (3) including a support rod (32) mounted thereon; and a chassis (4) mounted below the seat (2), the chassis (4) including a base (41), a positioning mechanism (42), a movable member (44), and a support frame (46);

the base (41) including a rear end fixedly connected to the support frame (46), the base (41) including an intermediate portion for connection with the positioning mechanism (42), the base (41) further including a front end on which two guide plates (414) are mounted for connecting with a front end of the movable member (44), each guide plate (414) having a guide slot (4141);

the positioning mechanism (42) including at least one positioning plate (421) and a control rod (422), said at least one positioning plate (421) being mounted to the base (41) and including an end connected to a rear end of the movable member (44), a top having a hole (4211)

defined therein, and an intermediate portion having a slot (4212) defined therein, the control rod (422) controlling said at least one positioning plate (421) to move between a loosened position and a tightening position for retaining the backrest in a desired inclination angle;

the movable member (44) including an upper end fixed to the seat (2), a front axle rod (444) being mounted to a front end of the movable member (44) and extending through the guide slots (4141) of the guide plates (414) of the base (41), a rear axle rod (445) being mounted to a rear end of the movable member (44) and extending through the hole (4211) of said at least one positioning plate (421);

the support frame (46) including a bottom fixed to a rear end of the base (41) and a top pivotally connected to the support rod (32) of the backrest (3);

wherein when the backrest (3) is tilted rearward, the seat (2) moves forward and urges the movable member (44) to shift, with the front axle rod (444) sliding along the guide slots (4141) of the guide plates (414), and with said at least one positioning plate (421) moving together with the rear axle rod (445).

2. The chair as claimed in claim 1, wherein said at least one positioning plate moves upward when the seat is moved forward, thereby carrying the rear end of the seat upward.

3. The chair as claimed in claim 1, wherein the slot (4211) of said at least one positioning plate (421) is extended through by an axle (423) to thereby mount said at least one positioning plate to the base (41), an elastic element (424) being mounted around the axle (423), a tightening member (425) being mounted to an end of the axle (423), the control rod (422) being pivotally connected to the base (41) and including an inclined side (4221) and a top side (4222), wherein said at least one positioning plate (421) is in the loosened position when the inclined side (4221) abuts against the axle (423), and wherein said at least one positioning plate (421) is in the tightening position when the top side (4222) presses against the axle (423), with the elastic element (424) biasing the tightening member (425) to press against and thus retain said at least one positioning plate (421).

4. The chair as claimed in claim 1, wherein the support rod (32) extends in a horizontal direction and located in an intermediate portion of the backrest (3).

* * * * *